United States Patent [19]

Brown

[11] 4,139,033

[45] Feb. 13, 1979

[54] PORTABLE TANK FOR RURAL FIRE FIGHTING

[76] Inventor: Wayne C. Brown, Box 498, Saegertown, Pa. 16433

[21] Appl. No.: 830,891

[22] Filed: Sep. 6, 1977

[51] Int. Cl.[2] ..... B65B 3/04

[52] U.S. Cl. ..... 141/363; 141/382; 220/85 R

[58] Field of Search ..... 141/99, 234, 285, 311 R, 141/363, 375, 382, 383, 386, 392, 231; 222/567; 285/61, 137 R; 220/85 R, 86 R, 85 SP

[56] References Cited

U.S. PATENT DOCUMENTS

| | | | |
|---|---|---|---|
| 1,337,558 | 4/1920 | King | 141/363 X |
| 1,532,000 | 3/1925 | Stuckey | 220/85 R |
| 2,122,227 | 6/1938 | Goehler | 220/85 R |
| 3,874,710 | 4/1975 | Courtot | 285/137 R |

*Primary Examiner*—Richard E. Aegerter
*Assistant Examiner*—Frederick R. Schmidt
*Attorney, Agent, or Firm*—Ralph Hammar

[57] ABSTRACT

A portable tank having a skeleton frame with a corner mounted fitting having an outlet discharging into the tank and an inlet for connection to a tank truck.

2 Claims, 4 Drawing Figures

PORTABLE TANK FOR RURAL FIRE FIGHTING

In rural fire fighting, where water is scarce, the first fire truck to arrive at the fire sets up a portable tank consisting of a skeleton frame with a rim supporting a flexible lining of canvas or the like for holding water. The next units which comes to the fire dump the contents of their tanks into the portable tank thereby providing a continuous reservoir for fire fighting.

To speed up the filling of the tank, a fitting is provided having one or more elbows with inlet ends receiving the hose of a tank truck and having outlet ends discharging into the tank. The elbows are rigidly fixed to the tank frame so that as soon as the hoses are coupled to the elbows, the tank is filled without requiring the presence of any firemen.

In a preferred form, the fitting has a plate seated on a corner of the frame with recesses on the under side receiving the struts which form the corner and with a locking type pliers clamping the plate to the struts. This provides a structure which can be fixed in place in a matter of seconds and which holds the elbows in fixed relation to the rim of the frame so that the incoming water is properly directed into the tank.

Figure 1:
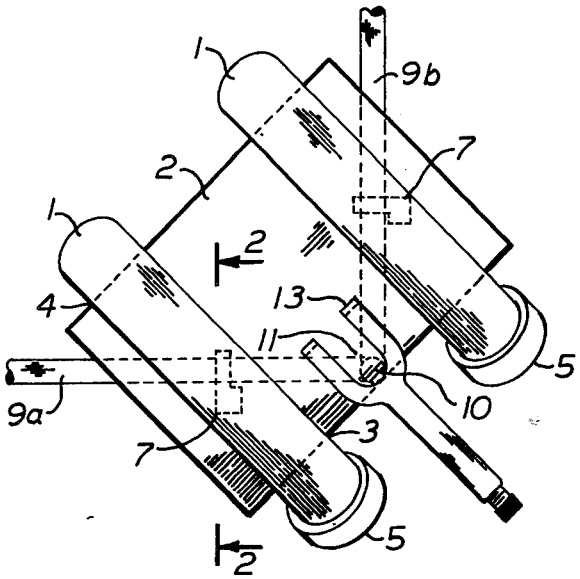
Figure 2:
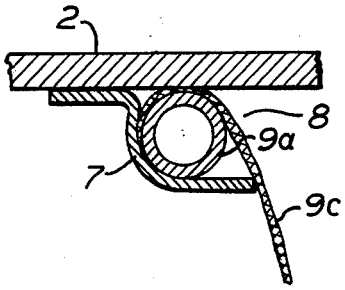
Figure 3:
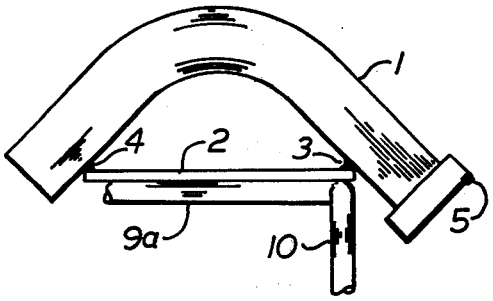
Figure 4:
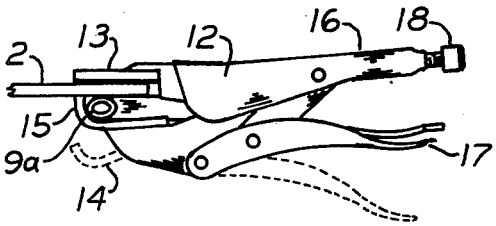

In the drawings, FIG. 1 is a top plan view of a corner of a portable tank with the attachment in place, FIG. 2 is a fragramentary section on line 2-2 showing the attachment hooked to one of the corner struts, FIG. 3 is a side view showing the relation of the elbows to the corner, and FIG. 4 is a side view showing the clamp for fixing the attachment to the corner of the tank.

The attachment has one or more elbows 1 arched over the top of a plate 2 and each welded at 3, 4 to the front and back edges of the plate. The inlet ends of the elbows each have a quick detachable coupling 5 for connection to a fire hose. The size of the coupling matches the size of the hose couplings on the fire trucks of the type which have water tanks so that the trucks can be used in areas outside water distribution systems. On the under side of the plate 2 are fixed hook members 7 which define recesses 8 for receiving the corner struts 9a, 9b of a portable tank. These corner struts are of light weight material and are typically tubes. The portable tanks generally have a rectangular top frame for supporting the upper edges of a tank 9c of canvas or other flexible water holding material. The top frame is supported by vertical struts 10. The frame is usually foldable to require less storage space and on arrival at the scene of the fire can be unfolded and quickly set up. This attachment is adapted for use with the presently available tanks.

The attachment is held on the corner 11 of the tank frame by a suitable clamp which may for example be a locking type pliers having an upper jaw 13 fixed to the upper surface of the plate 1 and a lower jaw 14 which in the open position shown in dotted lines in FIG. 4 is below the corner struts and in the full line or clamping position has its end 15 hooked over the corner struts. When pliers are closed by handles 16, 17 the jaws are locked in clamping relation. The pliers have an adjusting screw 18 for adjusting the clamping force of the jaws in the locked or closed position. These pliers are commercially available. In the particular pliers illustrated the upper jaw 13 is of U shape and centered directly over the corner 11 in the mounting position. The lower jaw 14 is also of U shape it is similarly centered on the corner and the sides of this U straddle the corner strut 10.

The attachment is intended for use on the corners of the tank frame. To mount the attachment the plate 2 is rested on the top of the frame over the corner 11 and is pushed forward toward the corner. This causes the hooks 7 to engage the frame corner struts 9a, 9b and when engaged the attachment is naturally centered on the corner with the lower jaw 14 aligned with the corner strut 10. On closing of the jaws 13, 14 the attachment is securely locked in place.

I claim:

1. The combination of a portable water tank for fire fighting having a frame including horizontal struts forming a corner rim of said tank and a filling supply structure for filling the tank from a hose without requiring the presence of any firemen, said filling structure comprising a plate received on said corner rim, a pipe fixed to said plate and arched over said corner rim and having its outlet end discharging into the tank and its inlet end outside the tank, means for clamping said plate to said corner rim, the means for clamping said plate to said corner rim comprising hook members fixed on the underside of said plate positioned to engage opposite sides of said corner rim and having free ends extending beneath the rim and providing recesses receiving said corner rim, and a clamp on said plate having a jaw hooked over the underside of said corner rim when said corner rim is struts are received in said recesses for fastening said plate to said corner rim and blocking removal of said corner rim struts from said recesses, and a hose fitting on the inlet end of the pipe for coupling the pipe to a supply hose.

2. The structure of claim 1 in which the corner rim has a vertical strut at the corner and the jaw of the clamp is U shaped with the vertical strut received between the sides of the U.

* * * * *